US008757358B2

(12) United States Patent
Krämer et al.

(10) Patent No.: US 8,757,358 B2
(45) Date of Patent: Jun. 24, 2014

(54) LABELING MACHINE FOR LABELING CONTAINERS, SUCH AS BOTTLES, CANS, AND SIMILAR CONTAINERS

(75) Inventors: Klaus Krämer, Dortmund (DE); Winfried Schlüter, Horstmar (DE)

(73) Assignee: KHS GmbH, Dortmund (DE)

( * ) Notice: Subject to any disclaimer, the term of this patent is extended or adjusted under 35 U.S.C. 154(b) by 116 days.

(21) Appl. No.: 12/323,029

(22) Filed: Nov. 25, 2008

(65) Prior Publication Data

US 2009/0294069 A1 Dec. 3, 2009

Related U.S. Application Data

(63) Continuation-in-part of application No. PCT/EP2007/004505, filed on May 22, 2007.

(30) Foreign Application Priority Data

May 26, 2006 (DE) ..... 10 2006 025 010

(51) Int. Cl.
*B65C 9/04* (2006.01)
*B65C 9/06* (2006.01)

(52) U.S. Cl.
USPC ..... 198/437; 156/362; 156/567; 700/125

(58) Field of Classification Search
None
See application file for complete search history.

(56) References Cited

U.S. PATENT DOCUMENTS

| | | | | |
|---|---|---|---|---|
| 4,366,542 | A * | 12/1982 | Anselrode | 700/125 |
| 6,494,238 | B2 * | 12/2002 | Sindermann | 141/6 |
| 6,810,292 | B1 * | 10/2004 | Rappenecker et al. | 700/82 |
| 2007/0007055 | A1 | 1/2007 | Schmidt et al. | |

FOREIGN PATENT DOCUMENTS

| | | |
|---|---|---|
| DE | 31 37 201 | 3/1983 |
| DE | 100 34 907 | 1/2002 |
| DE | 10 2004 054 601 | 6/2005 |
| JP | 1292505 | 11/1989 |
| JP | 11065645 | 3/1999 |
| JP | 2000218577 | 8/2000 |
| JP | 2002136057 | 5/2002 |
| JP | 2004336879 | 11/2004 |
| WO | WO 2005/068301 | 7/2005 |

OTHER PUBLICATIONS

International Search Report PCT/EP2007/004505 and English translation thereof.

International Preliminary Report on Patentability PCT/EP2007/004505 and English translation thereof.

* cited by examiner

*Primary Examiner* — Kavel Singh
(74) *Attorney, Agent, or Firm* — Nils H. Ljungman & Associates

(57) ABSTRACT

A labeling machine for labeling containers such as bottles, cans, and similar containers. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

17 Claims, 4 Drawing Sheets

LABELING MACHINE FOR LABELING CONTAINERS, SUCH AS BOTTLES, CANS, AND SIMILAR CONTAINERS

CONTINUING APPLICATION DATA

This application is a Continuation-In-Part application of International Patent Application No. PCT/EP2007/004505, filed on May 22, 2007, which claims priority from Federal Republic of Germany Patent Application No. 10 2006 025 010.9, filed on May 26, 2006. International Patent Application No. PCT/EP2007/004505 was pending as of the filing date of this application. The United States was an elected state in International Patent Application No. PCT/EP2007/004505.

BACKGROUND

1. Technical Field

This application relates to labeling machines for labeling containers, such as bottles, cans, and similar containers. The containers may be used to contain or store different products, such as beverages. In general, the labeling machines apply a label or labels to the exterior surface of the containers after they have been filled and closed in other sections of a bottling or container filling plant. The labeling machines are often of a rotary style in that they comprise a rotor that rotates about a vertical axis, with a plurality of container support structures positioned about or on the periphery of the rotor. As the rotor rotates, the container support structures and the containers supported thereon or thereby are moved past at least one labeling machine which applies a label onto the container. The containers may also be moved past inspection devices which inspect the orientation of the container in or on the support structure, or which inspect the placement and orientation of the labels on the containers after application.

This application further relates to container handling machines, such as filling, closing, and cleaning machines, which may be used in a container filling or beverage bottling plant. This application also further relates to an actuator servo control device for use on devices or machines for the handling of bottles, cans and similar containers with a drive element, such as an electric-motor drive element, with an electronic control and/or monitoring system and with a sensor system for the detection and measurement of operating conditions or parameters of the servo control device.

2. Background Information

Background information is for informational purposes only and does not necessarily admit that subsequently mentioned information and publications are prior art.

Some devices or machines for the handling of bottles, cans or similar containers, have a plurality of handling positions formed on the periphery of a rotor which is driven in rotation around a vertical machine axis, and specifically whereby each position has a plate-shaped container carrier. Located on the container carriers are the containers, standing upright on their container bottoms and with their container axis oriented in the vertical direction, and as the rotor rotates, the containers are moved past processing stations. For example, when the machine is realized in the form of a labeling machine the containers are moved past labeling units.

For the placement of the containers in an orientation for the handling operation (e.g. the application of the labels), the container carriers can be rotated in a controlled manner around a container carrier axis by means of a servo control device. Each servo control device thereby forms, together with an electric-motor drive, with an electronic control system and with at least one sensor that measures the angular position or the respective angle of rotation of the electric-motor drive and thus also of the container carrier, a fully functional modular assembly which is provided interchangeably on the rotor and is connected via an external bus system, which is partially also realized in the rotor, with a central computer that controls the machine for the transmission of control commands, among other things.

As a result of the modular realization of the servo control devices it is possible, among other things, to replace a defective servo control device with a properly operating servo control device and to perform any repair of the defective servo control device that may be appropriate or necessary outside the machine, for example also in a special or repair plant which is independent of the user of the machine. One disadvantage of this arrangement is that the causes of defects or malfunctions in many cases can no longer be traced, especially after the servo control device has been removed from the machine, and can often times only be identified by means of a complex, time-consuming and expensive troubleshooting process.

OBJECT OR OBJECTS

The object of at least one possible embodiment is to monitor the operation of a labeling machine, specifically the container support and handling structures for supporting and handling containers. The object of at least one other possible embodiment is to create a servo control device which overcomes this disadvantage.

SUMMARY

The application teaches that this object may possibly be accomplished by a servo control device for use on devices or machines for the handling of bottles, cans and similar containers with a drive element, such as an electric-motor drive element, with an electronic control and/or monitoring system and with a sensor system for the detection and measurement of operating conditions or parameters of the servo control device. The electronic control and/or monitoring system has at least one memory in which operating parameters measured by the sensor system and/or any errors or malfunctions that may occur during the operation of the servo control device are continuously or essentially continuous stored in the form of error data and/or messages.

The servo control device according to at least one possible embodiment can be used, for example, as a servo control device for container carriers in general, e.g. for plate-shaped container carriers on which the containers are oriented upright on their bases, and/or for container carriers on which the containers are held in a suspended position, and specifically for the orientation of the containers for the respective treatment such as labeling, for example. The servo control device according to at least one possible embodiment can also be used, however, for other functions on machines or devices for handling bottles, cans or other types of containers.

One advantage of the servo control device according to at least one possible embodiment is that the current operating parameters as well as error data or messages which are measured or generated by the electronic control and monitoring system of the servo control device by comparison of the measured or determined current operating parameters (as the actual value) with the specified setpoints for these operating parameters are stored continuously, i.e. in brief successive intervals of time, in the memory, which can be realized in the form of a flash memory, for example. The operating parameters and the error data or messages are thereby stored on the basis of a protocol together with the current datum and the current time.

The setpoints used for the determination of errors are thereby stored or memorized in the electronic control and regulation system, i.e. they can be stored in a fixed manner and/or, if these setpoints vary with the types of container that are currently being handled, the type of treatment etc., they can be input at the beginning of the process from the central control unit or from the central computer of the machine via the external bus system into the memory of the electronic control and regulation system of the servo control devices.

Any malfunctions or deviations from setpoints that occur can then be displayed, for example, via the external bus system on the central computer of the machine. Because the operating parameters and/or error data or messages are stored individually in the servo control devices, a diagnostic procedure can be conducted via the external bus system, for example, even while the machine is in operation, so that the malfunction or the error in one servo control device can be investigated while it is still installed in the machine, for example by transmitting the stored or recorded operating parameters and error data, e.g. remotely (e.g. via the Internet) to a plant or department that specializes in the repair of errors or malfunctions, for example to the manufacturer of the machine and/or of the associated servo control mechanisms.

If the servo control mechanism in question must be replaced to perform a repair, during the repair operation it becomes possible to perform a quick and easy error diagnosis and repair by reading the operating parameters and/or error data or messages stored.

The servo control device according to at least one possible embodiment also forms a modular unit which is fully functional and for its function, according to at least one possible embodiment, requires only a connection to the electric power supply and to external control lines, such as to an external bus system, for example.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Further possible embodiments are described hereinbelow. At least one possible embodiment is explained in greater detail below with reference to the exemplary embodiment illustrated in the accompanying figures, in which.

DESCRIPTION OF EMBODIMENT OR EMBODIMENTS

Figure 1:
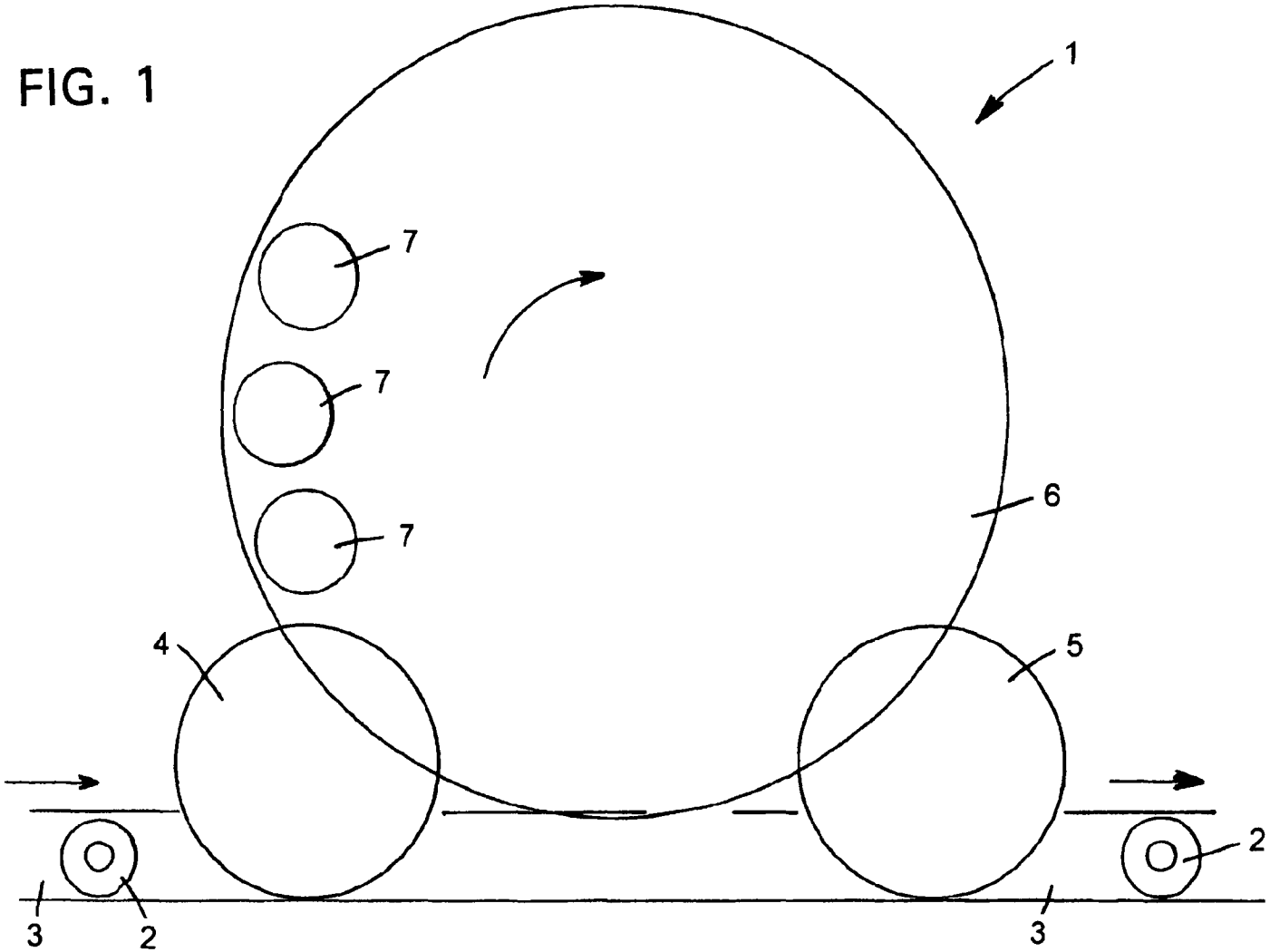
FIG. 1 is a simplified illustration in a plan view of a machine that employs a rotary design for the handling of bottles, cans or similar containers with a plurality of treatment positions formed on the periphery of a rotor.

The machine, which is designated 1 in general in the accompanying figures, is used for the handling of bottles, cans or similar containers 2 which are fed to the machine 1 by means of a conveyor 3 to a container inlet which is formed by a transport star wheel 4 and which, after the treatment, are removed by means of a conveyor 3 via a container outlet which is formed by a transport star wheel 5.

The machine 1, which can be used, for example, for the labeling and/or for the printing of the containers 2, has on the periphery of a rotor 6 which is driven in rotation around a vertical machine axis, a plurality of handling positions, each of which is formed by a container carrier 7, on which the containers 2 are delivered individually to the container inlet 4 and on which the containers 2, oriented upright standing on their bases, and oriented with their container axis in the vertical direction, are moved with the rotating rotor 6 past handling stations (not shown).

The container carriers 7 can be rotated in a controlled manner around their axis parallel or essentially parallel to the vertical machine axis, among other things to orient the containers 2, for example during printing and/or labeling, so that each container 2 can be brought by rotation of the container carrier 7 into the respective desired orientation.

Each container carrier 7 is part of a servo control device or module 8, i.e. of a fully functional, interchangeable assembly on the rotor 6, and in addition to an electric-motor drive 9 (electric servo motor, e.g. with gearing) on the output shaft of which the respective container carrier 7 is located contains the components for the control of the respective container carrier 7 and for the monitoring of functions, namely, among others:

- An electronic control and monitoring system 10, among other things for the actuation of the electric-motor drive 9, such as for the control of the individual rotational position and/or of the individual angle of rotation of the container carrier 7 and, among other things, also for the continuous monitoring of the operating condition and the operating parameters of the module 8 and the generation and storage of error data or messages in the event of errors of malfunctions,
- a sensor array 11 that has at least one sensor, among other things for the determination of the rotational position and/or of the angle of rotation of the electric-motor drive 9 and thus of the container carrier 7,
- a sensor array 12 for the measurement of additional operating parameters, e.g. the temperature of the electric-motor drive 9, whereby the sensor array 12 has, for this purpose, a plurality of temperature sensors distributed over critical areas of this drive,
- a measurement device 13 for the measurement of different electrical operating parameters, for example of the current and/or voltage on the electric-motor drive 9 etc.

Figure 1A:
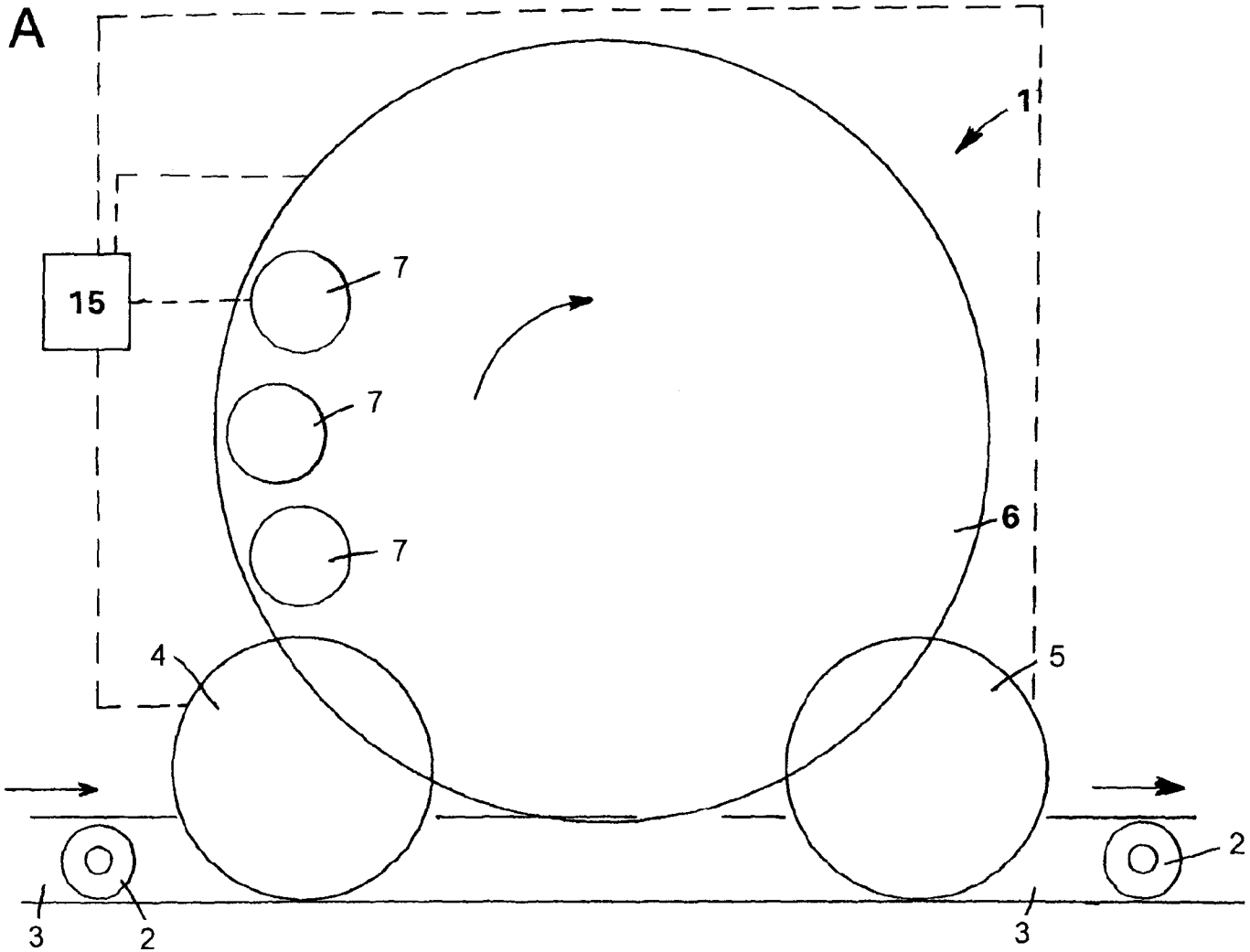
FIG. 1A shows the view in FIG. 1 with a control device.
Figure 2:
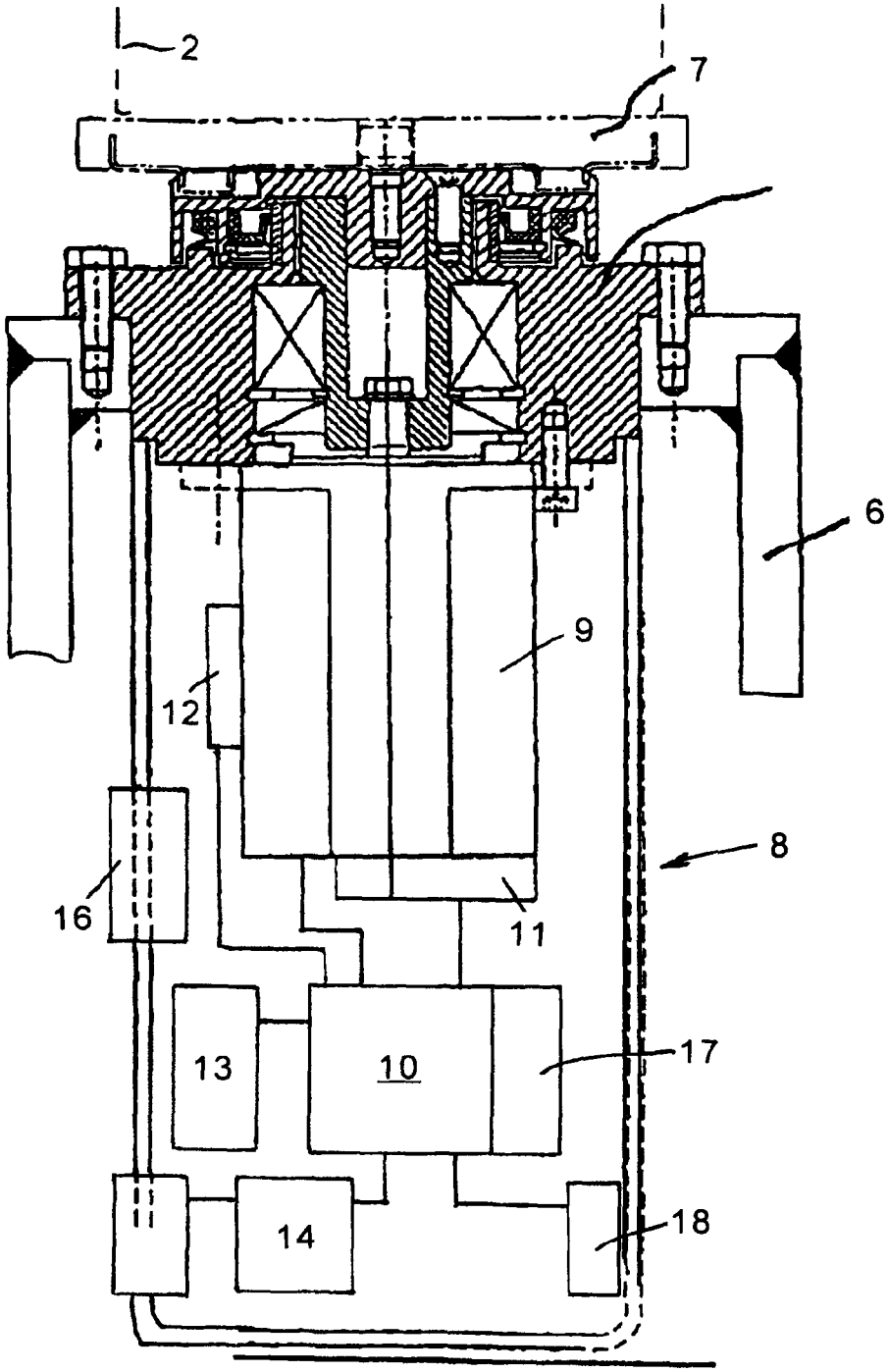
FIG. 2 is a simplified view of an interchangeable drive module of a work station.

The module 8 further contains an interface 14, via which the module 8 is in communication with an external bus system which is realized at least in part also on the rotor 6 for bidirectional data transmission, such as also for a transmission of control commands and other data such as, for example, error messages or the acknowledgment of control commands, with a central computer 15 (FIG. 1A) that controls the machine 1.

In addition to the interface 14 and the corresponding connections, the module 8 has at least one multiple-pole connection 16, for the electric power supply of the module 8 with the desired operating voltage or voltages.

One feature of the module 8 is that this module or the electronic control and regulation system 10 located with it is provided with a memory 17 which comprises, for example, a plurality of memory units, and in which at least all or substantially all the essential operating data or parameters are constantly or substantially constantly stored or recorded, as well as all or substantially all error data or messages of potential malfunctions, such as malfunctions in the area of the bus systems, deviations from the specified angular position and/or of the angle of rotation of the electric-motor drive 9 and/or of the container carrier 7 from their respected setpoints, unacceptable temperatures, elevated currents and thus torques of the electric-motor drive 9 etc., and specifically together with additional data which can be transmitted via, among other means, the external bus system such as, for example, the time, date, type of containers being handled etc.

To define the position of each module 8 on the periphery of the rotor 6, it is also possible to provide on each module 8 a unit 18, for example a reader unit, with which a code that defines the current position on the rotor 5 can be read, and which is then also stored, for example, in the memory 17 of the electronic control and monitoring system 10. If the electronic control and monitoring system 10 is formed by a microprocessor, the necessary programs are also stored in the memory 17.

The storage of the operating parameters and error data and messages is always or essentially always up to date, and specifically so that the corresponding data can be read into the memory 17 and/or into a prepared storage location continuously at specified short intervals of time, and when the maximum memory capacity is reached, the oldest data are deleted to create storage space for additional, such as new and more recent data.

The electronic control and monitoring system 10 is further realized so that in the event of serious errors or malfunctions, and/or if a specified error occurs frequently, an error message is sent via the external bus system to the central computer 15 so that a targeted error diagnosis and possible a targeted replacement of the defective module 8 becomes possible.

With the information stored in the memory 17 it is possible, among other things, to analyze a module 8 removed from the machine outside the machine by reading the contents of the memory 17 for errors and to repair the module if necessary. It is also possible, however, during the operation of the machine 1, to individually read the contents of the individual error memory 17 of a module 8 via the external bus system without uninstalling this module for troubleshooting, so that it is then possible, while the machine is still in operation or when the machine is subsequently shut down, to remedy the causes of the malfunctions that have occurred or to replace the module 8 in question and send it for repair.

At least one possible embodiment was explained above on the basis of one exemplary embodiment. It goes without saying that numerous modifications and variations can be made without thereby going beyond the teaching of at least one possible embodiment.

In the preceding description, it was assumed that the module 8 is being used for the controlled movement of an individual plate-shaped container carrier 7. Of course, the drive module 8 can also be used for the controlled movement of other elements of a machine or apparatus for the treatment of containers 2, e.g. also for the controlled movement of container carriers on which the containers are held in a suspended position.

Figure 3:
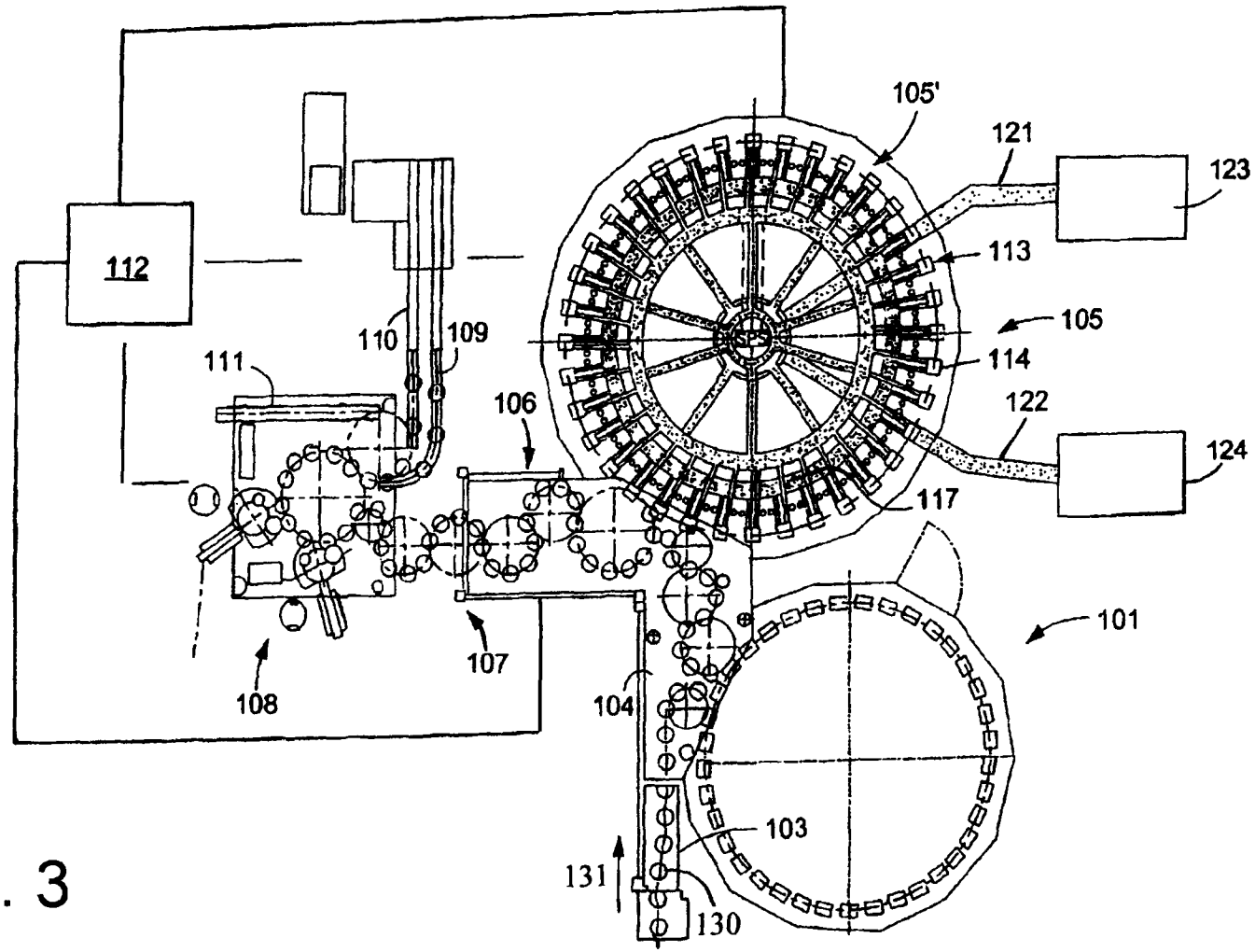
FIG. 3 shows schematically the main components of one possible embodiment example of a system for filling containers, specifically, a beverage bottling plant for filling bottles with at least one liquid beverage, in accordance with at least one possible embodiment.

FIG. 3 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 3 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 3, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

On a servo control device for use on devices or machines for the handling of bottles, cans and similar containers with an electronic control and/or monitoring system and with a sensor system for the detection and measurement of operating conditions or parameters of the servo control device, the electronic control and/or monitoring system has at least one memory in which operating parameters measured by the sensor system and/or any errors or malfunctions that may occur during the operation of the servo control device are continuously stored.

One feature or aspect of an embodiment is believed at the time of the filing of this patent application to possibly reside broadly in a servo control device for use on devices or machines for the handling of bottles, cans and similar containers 2 with a drive element 9, such as an electric-motor drive element, with an electronic control and/or monitoring system 10 and with a sensor system 11, 12 for the detection and measurement of operating conditions or parameters of the servo control device 8, characterized in that the electronic control and/or monitoring system 10 has at least one memory 17 in which operating parameters measured by the sensor system and/or any errors or malfunctions that may occur during the operation of the servo control device 8 are continuously stored in the form of error data and/or messages.

Another feature or aspect of an embodiment is believed at the time of the filing of this patent application to possibly reside broadly in the servo control device, characterized in that the memory 17 and/or the memory space provided for the storage of the operating parameters and/or of any malfunctions is configured so that when its limit of capacity has been reached, the oldest data are deleted to make room for the storage of new data.

Yet another feature or aspect of an embodiment is believed at the time of the filing of this patent application to possibly reside broadly in the servo control device, characterized in that the operating parameters and/or error data or messages are stored individually in the memory 17 together with the date and/or the time.

Still another feature or aspect of an embodiment is believed at the time of the filing of this patent application to possibly reside broadly in the servo control device, characterized in that the operating parameters measured by the sensor system 11, 12 and stored in the memory 17 are temperatures and/or actuator positions and/or actuator travel and/or torques of the motor drive.

A further feature or aspect of an embodiment is believed at the time of the filing of this patent application to possibly reside broadly in the servo control device, characterized in that the error data stored in the memory includes unacceptable temperatures and/or unacceptable deviations of the actuator positions and/or actuator travel and/or torque of the motor drive from the specified setpoints or thresholds.

Another feature or aspect of an embodiment is believed at the time of the filing of this patent application to possibly reside broadly in the servo control device, characterized in that the sensor system has at least one temperature sensor 12 and/or an actuator position or distance sensor 11 that detects the actuator travel of the motor drive and/or a torque sensor.

Yet another feature or aspect of an embodiment is believed at the time of the filing of this patent application to possibly reside broadly in the servo control device, characterized in that when an electric-motor drive 10 is used, the sensor system has a motor current measurement device 13 for the measurement of the torque.

Still another feature or aspect of an embodiment is believed at the time of the filing of this patent application to possibly reside broadly in the servo control device, characterized in that the electronic control and monitoring system 1 is realized for a data exchange, such as for a bidirectional data exchange, via an external bus system.

One feature or aspect of an embodiment is believed at the time of the filing of this patent application to possibly reside broadly in a labeling machine for labeling containers comprising bottles, cans, and similar containers, said labeling machine comprising: a rotor being configured to rotate about a central, vertical axis; a plurality of container support structures being disposed on and about the periphery of said rotor; at least one labeling device being disposed adjacent the periphery of said rotor and being configured to apply or print labels on containers; and each of said container support structures comprising: a support plate being configured and disposed to support the bottom of a container thereon; a drive arrangement being operatively connected to said support plate to rotate said support plate and thus a container disposed on said support plate to change the orientation of the container with respect to said at least one labeling device; and said drive arrangement comprising: a drive element being connected to said support plate to rotate said support plate; a control arrangement being operatively connected to said drive element to control and monitor the operation of said drive element; said control arrangement comprising sensors being configured to detect and measure operating conditions of said drive arrangement; said control arrangement being configured to compare detected operating conditions of said drive arrangement with desired operating conditions of said drive arrangement to detect errors or malfunctions; and said control arrangement comprising a storage device being configured to store operating information detected and measured by said sensors and errors or malfunctions detected by said control arrangement.

Another feature or aspect of an embodiment is believed at the time of the filing of this patent application to possibly reside broadly in the labeling machine, wherein said storage device is configured, upon reaching its limit of capacity, to delete the chronologically oldest information to permit storage of new information.

Yet another feature or aspect of an embodiment is believed at the time of the filing of this patent application to possibly reside broadly in the labeling machine, wherein operating information detected and measured by said sensors and errors or malfunctions detected by said control arrangement are stored individually in said storage device together with at least one of the date and the time.

Still another feature or aspect of an embodiment is believed at the time of the filing of this patent application to possibly reside broadly in the labeling machine, wherein operating information detected and measured by said sensors comprises at least one of: temperatures, actuator positions, actuator travel, and torques of said drive element.

A further feature or aspect of an embodiment is believed at the time of the filing of this patent application to possibly reside broadly in the labeling machine, wherein errors or malfunctions detected by said control arrangement comprises deviations from at least one of: desired temperatures, desired actuator positions, desired actuator travel, and desired torques of said drive element.

Another feature or aspect of an embodiment is believed at the time of the filing of this patent application to possibly reside broadly in the labeling machine, wherein said sensors comprise at least one of: at least one temperature sensor, an actuator position or distance sensor configured to detect the actuator travel of said drive element, and a torque sensor.

Yet another feature or aspect of an embodiment is believed at the time of the filing of this patent application to possibly reside broadly in the labeling machine, wherein: said control arrangement comprises an electronic control and monitoring arrangement; said storage device comprises at least one electronic memory; said drive element comprises an electrical motor; said sensors comprise a motor current measurement device for the measurement of the torque; and said control arrangement is configured to perform a bidirectional data exchange via an external bus arrangement with a central computer control arrangement.

Another feature or aspect of an embodiment is believed at the time of the filing of this patent application to possibly reside broadly in a labeling machine for labeling containers comprising bottles, cans, and similar containers, said labeling machine comprising: a rotor being configured to rotate about a central, vertical axis; a plurality of container support structures being disposed on and about the periphery of said rotor; at least one labeling device being disposed adjacent the periphery of said rotor and being configured to apply or print labels on containers; and each of said container support structures comprising: a support plate being configured and disposed to support the bottom of a container thereon; a drive arrangement being operatively connected to said support plate to rotate said support plate and thus a container disposed on said support plate to change the orientation of the container with respect to said at least one labeling device; and said drive arrangement comprising: a drive element being connected to said support plate to rotate said support plate; a control arrangement being operatively connected to said drive element to control and monitor the operation of said drive element; said control arrangement comprising sensors being configured to detect and measure operating conditions of said drive arrangement; said control arrangement being configured to compare detected operating conditions of said drive arrangement with desired operating conditions of said drive arrangement to detect errors or malfunctions; and said control arrangement comprising a storage device being configured to store errors or malfunctions detected by said control arrangement.

Yet another feature or aspect of an embodiment is believed at the time of the filing of this patent application to possibly reside broadly in the labeling machine, in combination with a beverage bottle filling plant, wherein said beverage bottle filling plant comprises: a filling machine being configured and disposed to fill empty beverage bottles with a liquid beverage; a first moving arrangement being configured and disposed to move beverage bottles to said filling machine; said filling machine comprising: a moving device being configured and disposed to accept beverage bottles from said first moving arrangement and to move beverage bottles within said filling machine; an apparatus being configured and disposed to hold beverage bottles during filling; and at least one filling device being configured and disposed to fill beverage bottles with a liquid beverage upon the beverage bottles being within said filling machine; a closing machine being configured and disposed to close filled beverage bottles; a second moving arrangement being configured and disposed to accept filled beverage bottles from said moving device of said filling machine to move filled beverage bottles out of said filling machine; said second moving arrangement being configured and disposed to move filled beverage bottles from said filling machine to said closing machine; said closing machine comprising: a moving device being configured and disposed to accept filled beverage bottles from said second moving arrangement and to move filled beverage bottles within said closing machine; an apparatus being configured and disposed to hold filled beverage bottles during closing; and at least one closing device being configured and disposed to close filled beverage bottles upon the filled beverage bottles being within said closing machine; a third moving arrangement being configured and disposed to accept closed beverage bottles from said moving device of said closing machine to move closed beverage bottles out of said closing machine; and said third moving arrangement being configured and disposed to move closed beverage bottles from said closing machine to said labeling machine.

Still another feature or aspect of an embodiment is believed at the time of the filing of this patent application to possibly reside broadly in a container handling device for handling containers comprising bottles, cans, and similar containers, said handling device comprising: a container support structure being configured and disposed to support a container; a drive arrangement being operatively connected to said support structure to rotate said support structure and thus a container supported by said support plate to change the orientation of the container in the container handling device; said drive arrangement comprising: an electric-motor drive element being connected to said support structure to rotate said support structure; an electronic control arrangement being operatively connected to said drive element to control and monitor the operation of said drive element; said control arrangement comprising sensors being configured to detect and measure operating conditions of said drive arrangement; said control arrangement being configured to compare detected operating conditions of said drive arrangement with desired operating conditions of said drive arrangement to detect errors or malfunctions; and said control arrangement comprising a memory storage device being configured to store errors or malfunctions detected by said control arrangement.

A further feature or aspect of an embodiment is believed at the time of the filing of this patent application to possibly reside broadly in the container handling device, wherein said storage device is configured, upon reaching its limit of capacity, to delete the chronologically oldest information to permit storage of new information.

Another feature or aspect of an embodiment is believed at the time of the filing of this patent application to possibly reside broadly in the container handling device, wherein: errors or malfunctions detected by said control arrangement are stored individually in said storage device together with at least one of the date and the time; and operating information detected and measured by said sensors comprises at least one of: temperatures, actuator positions, actuator travel, and torques of said drive element.

Yet another feature or aspect of an embodiment is believed at the time of the filing of this patent application to possibly reside broadly in the container handling device, wherein: errors or malfunctions detected by said control arrangement comprises deviations from at least one of: desired temperatures, desired actuator positions, desired actuator travel, and desired torques of said drive element; and said sensors comprise at least one of: at least one temperature sensor, an actuator position or distance sensor configured to detect the actuator travel of said drive element, and a torque sensor.

Still another feature or aspect of an embodiment is believed at the time of the filing of this patent application to possibly reside broadly in the container handling device, wherein: said sensors comprise a motor current measurement device for the measurement of the torque; and said control arrangement is configured to perform a bidirectional data exchange via an external bus arrangement with a central computer control arrangement.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that any or all the examples of patents, published patent applications, and other documents which are included in this application and including those which are referred to in paragraphs which state "Some examples of . . . which may possibly be used in at least one possible embodiment of the present application . . . " may possibly not be used or useable in any one or more or any embodiments of the application.

The sentence immediately above relates to patents, published patent applications and other documents either incorporated by reference or not incorporated by reference.

Some examples of control systems which measure operating parameters and learn therefrom that may possibly be utilized or possibly adapted for use in at least one possible embodiment of the present application may possibly be found in the following U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

Some examples of open-loop control systems that may possibly be utilized or possibly adapted for use in at least one possible embodiment of the present application may possibly be found in the following U.S. Pat. No. 5,770,934 issued to Theile on Jun. 23, 1998; U.S. Pat. No. 5,210,473 issued to Backstrand on May 11, 1993; U.S. Pat. No. 5,320,186 issued to Strosser et al. on Jun. 14, 1994; and U.S. Pat. No. 5,369,342 issued to Rudzewicz et al. on Nov. 29, 1994.

Some examples of closed-loop control circuits that may possibly be utilized or possibly adapted for use in at least one possible embodiment of the present application may possibly be found in the following U.S. Pat. No. 5,770,934 issued to Theile on Jun. 23, 1998; U.S. Pat. No. 5,189,605 issued to Zuehlke et al. on Feb. 23, 1993; U.S. Pat. No. 5,223,072 issued to Brockman et al. on Jun. 29, 1993; and U.S. Pat. No. 5,252,901, issued to inventors Ozawa et al. on. Oct. 12, 1993.

Some examples of cameras or the like optical monitoring apparatus that may possibly be utilized or possibly adapted for use in at least one possible embodiment of the present application may possibly be found in the following U.S. Pat. No. 5,233,186 issued to Ringlien on Aug. 3, 1993; U.S. Pat. No. 5,243,400 issued to Ringlien on Sep. 7, 1993; U.S. Pat. No. 5,369,713 issued to Schwartz et al. on Nov. 29, 1994; U.S. Pat. No. 5,442,446 issued to Gerber et al. on Aug. 15, 1995; U.S. Pat. No. 5,661,295 issued to Buchmann et al. on Aug. 26, 1997; and U.S. Pat. No. 5,898,169 issued to Nodbryhn on Apr. 27, 1999.

Some examples of interface arrangements that may possibly be utilized or possibly adapted for use in at least one possible embodiment of the present application may possibly be found in the following U.S. Pat. No. 5,001,704 issued to Narup et al. on Mar. 19, 1991; U.S. Pat. No. 5,961,356 issued to Fekete on Oct. 5, 1999; U.S. Pat. No. 6,621,692 issued to Johnson et al. on Sep. 16, 2003; U.S. Pat. No. 6,661,961 issued to Allen et al. on Dec. 9, 2003; U.S. Pat. No. 6,687,166 issued to Takahashi et al. on Feb. 3, 2004; and U.S. Pat. No. 6,687,779 issued to Sturm et al. on Feb. 3, 2004.

Some examples of rotation sensors that may possibly be utilized or possibly adapted for use in at least one possible embodiment of the present application may possibly be found in the following U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025,684 issued to Yasui on Feb. 15, 2000.

Some examples of synchronous motors which may possibly be utilized or adapted for use in at least one possible embodiment may possibly be found in the following U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

Some examples of timer apparatus that may possibly be utilized or possibly adapted for use in at least one possible embodiment of the present application may possibly be found in the following U.S. Pat. No. 5,910,739 issued to Stanojevic on Jun. 8, 1999; U.S. Pat. No. 5,999,087 issued to Gunton on Dec. 7, 1999; U.S. Pat. No. 6,016,531 issued to Rixner et al. on Jan. 18, 2000; U.S. Pat. No. 6,020,697 issued to Stenger et al. on Feb. 1, 2000; U.S. Pat. No. 6,020,775 issued to Chevallier on Feb. 1, 2000; and U.S. Pat. No. 6,038,197 issued to Phillips on Mar. 14, 2000.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

Some examples of temperature sensors or sensor systems that may be used or adapted for use in at least one possible embodiment of the present invention may be found in the following U.S. Pat. No. 5,960,857, issued to inventors Oswalt et al. on Oct. 5, 1999; U.S. Pat. No. 5,942,980, issued to inventors Hoben et al. on Aug. 24, 1999; U.S. Pat. No. 5,881,952, issued to inventor MacIntyre on Mar. 16, 1999; U.S. Pat. No. 5,862,669, issued to inventors Davis et al. on Jan. 26, 1999; U.S. Pat. No. 5,459,890, issued to inventor Jarocki on Oct. 24, 1995; U.S. Pat. No. 5,367,602, issued to inventor Stewart on Nov. 22, 1994; U.S. Pat. No. 5,319,973, issued to inventors Crayton et al. on Jun. 14, 1994; U.S. Pat. No. 5,226,320, issued to inventors Dages et al. on Jul. 13, 1993; U.S. Pat. No. 5,078,123, issued to inventors Nagashima et al. on Jan. 7, 1992; and U.S. Pat. No. 5,068,030, issued to inventor Chen on Nov. 26, 1991.

Some examples of position sensors or position sensor systems that may be used or adapted for use in at least one possible embodiment of the present invention may be found in the following U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

All of the patents, patent applications or patent publications, which were cited in the International Search Report dated Aug. 31, 2007, and/or cited elsewhere are hereby incorporated by reference as if set forth in their entirety herein as follows: DE 100 34 907 and WO 2005/068301.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 025 010.9, filed on May 26, 2006, having inventors Klaus KRÄMER and Winfried SCHLÜTER, and DE-OS 10 2006 025 010.9 and DE-PS 10 2006 025 010.9, and International Application No. PCT/EP2007/004505, filed on May 22, 2007, having WIPO Publication No. WO 2007/137728 and inventors Klaus KRÄMER and Winfried SCHLÜTER, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/004505 and German Patent Application 10 2006 025 010.9 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/004505 and German Patent Application 10 2006 025 010.9 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Machine
2 Container
3 Conveyor
4 Container inlet or inlet star wheel
5 Container outlet or outlet star wheel
6 Rotor
7 Container carrier
8 Module
9 Electric-motor drive
10 Electronic control and monitoring system
11, 12 Sensor array
13 Measurement instrument
14 Interface
15 Central computer for control of the machine 1
16 Multiple-pole connection for the power supply or power supplies
17 Memory for storage of errors and operating parameters
18 Reader unit

What is claimed is:

1. A container handling machine servo control device comprising:

an electric motor drive element;

a sensor system configured to determine operating conditions or parameters of said servo control device;

an electronic control and/or monitoring system comprising at least one memory in which determined operating conditions or parameters, within and/or outside of predetermined operating conditions or parameters, are stored during operation of a container handling machine; and said at least one memory is configured, upon reaching its limit of capacity, to delete the chronologically oldest information to permit storage of new information.

2. The container handling machine servo control device according to claim 1, wherein said at least one memory is configured to store determined operating conditions or parameters individually with at least one of the date and the time.

3. The container handling machine servo control device according to claim 2, wherein said at least one memory is configured to store determined operating conditions or parameters comprising at least one of: acceptable and/or unacceptable temperatures of said electric motor drive element, acceptable and/or unacceptable angular positions of said electric motor drive element in a rotary container handling machine, acceptable and/or unacceptable angles of rotation of said electric motor drive element, and acceptable and/or unacceptable torques of said electric motor drive element, which unacceptable temperatures, angular positions, angles of rotation, and torques are those which deviate from or are outside of specified setpoints or thresholds stored in said at least one memory.

4. The container handling machine servo control device according to claim 3, wherein said sensor system comprises at least one of: a temperature sensor, a sensor arrangement configured to detect angular positions and angles of rotation of said electric motor drive element, and a torque sensor to detect the torque of said electric motor drive element.

5. The container handling machine servo control device according to claim 4, wherein said sensor system comprises a motor current measurement device for the measurement of the torque.

6. The container handling machine servo control device according to claim 5, wherein said electronic control and/or monitoring system is configured to perform a bidirectional data exchange via an external bus arrangement with a central computer control arrangement.

7. A container handling machine servo control device comprising:

an electric motor drive element;

a sensor system configured to determine operating conditions or parameters of said servo control device;

an electronic control and/or monitoring system comprising at least one memory in which determined operating conditions or parameters, within and/or outside of predetermined operating conditions or parameters, are stored during operation of a container handling machine;

said servo control device comprises a modular unit configured to be detachably connected to a container handling machine; and upon removal of said servo control device from a container handling machine, said at least one memory is configured to permit later access to the stored determined operating conditions or parameters at a location remote from the container handling machine to facilitate diagnosis and repair of at least a portion of said servo control device.

8. The container handling machine servo control device according to claim 7, wherein said sensor system comprises at least one of: a temperature sensor configured to measure temperatures of said electric motor drive element, a sensor arrangement configured to detect angular positions in the container handling machine and angles of rotation of said electric motor drive element, and a torque sensor to detect the torque of said electric motor drive element.

9. The container handling machine servo control device according to claim 8, wherein said sensor system comprises each of said temperature sensor, said sensor arrangement, and said torque sensor.

10. The container handling machine servo control device according to claim 9, wherein said electronic control and/or monitoring system is configured to perform a bidirectional data exchange via an external bus arrangement with a central computer control arrangement, and said at least one memory is configured to store determined operating conditions or parameters individually with at least one of the date and the time.

11. The container handling machine servo control device according to claim 7, wherein said electronic control and/or monitoring system is configured to provide the determined operating conditions or parameters to a location remote from the container handling machine to facilitate diagnosis and repair of at least a portion of said servo control device.

12. A container handling machine servo control device comprising:

an electric motor drive element;

a sensor system configured to determine operating conditions or parameters of said servo control device;

an electronic control and/or monitoring system comprising at least one memory in which determined operating conditions or parameters, within and/or outside of predetermined operating conditions or parameters, are stored during operation of a container handling machine;

said servo control device comprises a modular unit configured to be detachably connected to a container handling machine;

said electronic control and/or monitoring system is configured to provide the determined operating conditions or parameters to a location remote from the container handling machine to facilitate diagnosis and repair of at least a portion of said servo control device; and said sensor system comprises at least one of: a temperature sensor configured to measure temperatures of said electric motor drive element, a sensor arrangement configured to detect angular positions in the container handling machine and angles of rotation of said electric motor drive element, and a torque sensor to detect the torque of said electric motor drive element.

13. The container handling machine servo control device according to claim 12, wherein said sensor system comprises each of said temperature sensor, said sensor arrangement, and said torque sensor.

14. The container handling machine servo control device according to claim 13, wherein said electronic control and/or monitoring system is configured to perform a bidirectional data exchange via an external bus arrangement with a central computer control arrangement.

15. A container handling machine servo control device comprising:

an electric motor drive element;

a sensor system configured to determine operating conditions or parameters of said servo control device; and an electronic control and/or monitoring system comprising at least one memory in which determined operating conditions or parameters, within and/or outside of predetermined operating conditions or parameters, are stored during operation of a container handling machine; and said sensor system comprises at least one of: a temperature sensor configured to measure temperatures of said electric motor drive element, a sensor arrangement configured to detect angular positions in a rotary container handling machine and angles of rotation of said electric motor drive element, and a torque sensor to detect the torque of said electric motor drive element.

16. The container handling machine servo control device according to claim 15, wherein said sensor system comprises each of said temperature sensor, said sensor arrangement, and said torque sensor.

17. The container handling machine servo control device according to claim 16, wherein said electronic control and/or monitoring system is configured to perform a bidirectional data exchange via an external bus arrangement with a central computer control arrangement.

* * * * *